US007608322B2

(12) United States Patent
Thurau et al.

(10) Patent No.: US 7,608,322 B2
(45) Date of Patent: Oct. 27, 2009

(54) IMPACT RESISTIVE COMPOSITE MATERIALS AND METHODS FOR MAKING SAME

(75) Inventors: Courtney T. Thurau, Harleysville, PA (US); Mark David Conner, New Tripoli, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 11/950,709

(22) Filed: Dec. 5, 2007

(65) Prior Publication Data

US 2009/0145288 A1 Jun. 11, 2009

(51) Int. Cl.
*B32B 25/02* (2006.01)

(52) U.S. Cl. ..... 428/297.1; 428/911; 89/36.02; 442/134; 442/135

(58) Field of Classification Search ..... 428/297.1, 428/911; 442/134, 135; 89/36.02; 2/2.5
See application file for complete search history.

(56) References Cited

U.S. PATENT DOCUMENTS

| | | | | |
|---|---|---|---|---|
| 4,413,357 | A | 11/1983 | Sacks | |
| 6,532,857 | B1 * | 3/2003 | Shih et al. | 89/36.02 |
| 6,807,891 | B2 | 10/2004 | Fisher | |
| 6,846,545 | B2 | 1/2005 | Thomas | |
| 7,300,893 | B2 * | 11/2007 | Barsoum et al. | 442/134 |
| 2002/0178900 | A1 * | 12/2002 | Ghiorse et al. | 89/36.02 |
| 2006/0023967 | A1 * | 2/2006 | Hayashi et al. | 382/276 |
| 2006/0223967 | A1 | 10/2006 | Conner | |
| 2007/0017359 | A1 | 1/2007 | Gamache et al. | |
| 2007/0293107 | A1 * | 12/2007 | Follo et al. | 442/134 |
| 2009/0145288 | A1 * | 6/2009 | Thurau et al. | 89/36.02 |

FOREIGN PATENT DOCUMENTS

| | | |
|---|---|---|
| GB | 1556245 | 11/1979 |
| WO | 2005103363 A2 | 11/2005 |

OTHER PUBLICATIONS

US Dept of Justice, NIJ, Ballistic Resistance of Policy Body Armor, NIJ Standard 0101.03, Apr. 1987, pp. 1-21.
US Dept of Justice, NIJ, Ballistic Resistance of Personal Body Armor, NIJ Standard 0101.04, Jun. 2001, pp. 1-45.
US Dept of Justice, NIJ, Ballistic Resistance of Personal Body Armor, NIJ Standard 0101.4, May 2003, Addendum B, pp. 1-8.

* cited by examiner

*Primary Examiner*—N. Edwards
(74) *Attorney, Agent, or Firm*—Rosaleen P. Morris-Oskanian

(57) ABSTRACT

A composite material that is suitable for the protection of personnel and/or property from impact due to ballistic projectiles and method for making same are disclosed herein. In one embodiment, there is provided composite for resisting impact from an oncoming projectile having a front strike face and a back wear face comprising: an elastomer; and an impact resistive substrate wherein at least a portion of the impact resistive substrate is coated by the elastomer to provide the composite having a front strike face coating and a back wear face coating and wherein a ratio of weight of front strike face coating to back wear face coating ranges from 1:1.2 to 1:100.

13 Claims, 2 Drawing Sheets

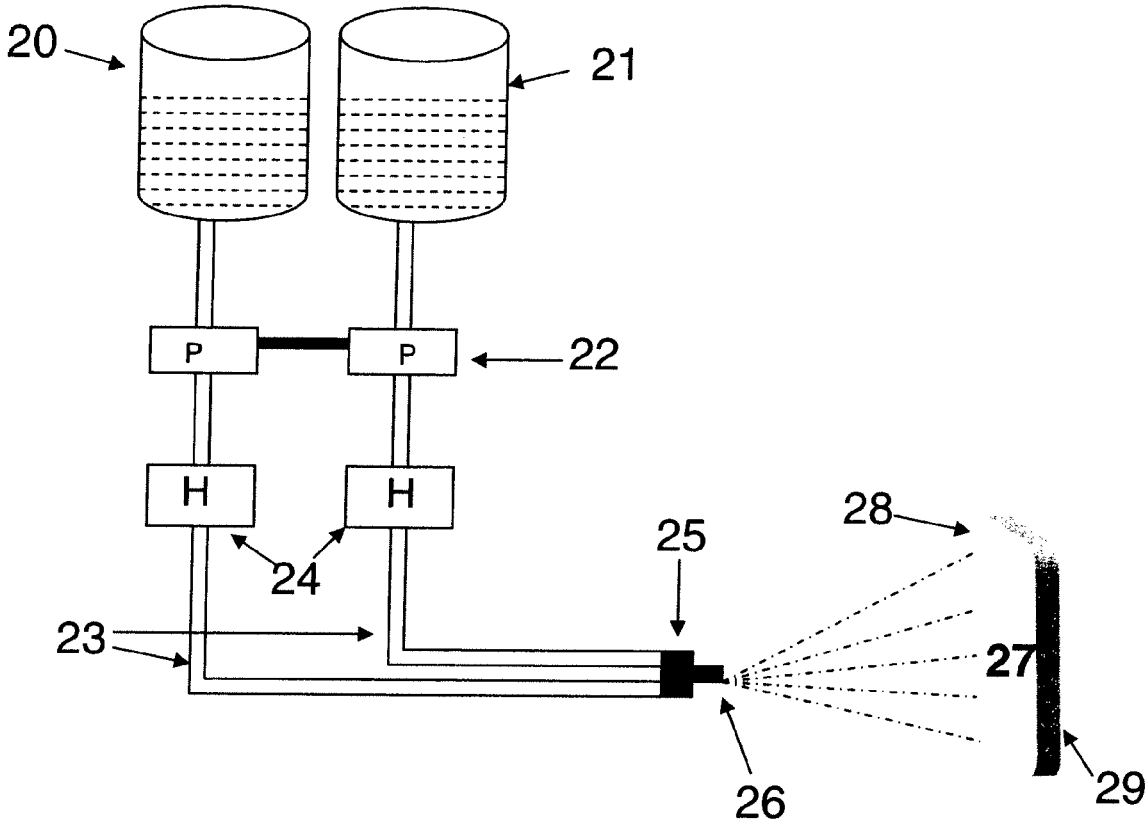
Figure 2. Plural Component Spray Equipment for Ballistic Substrate Coating

IMPACT RESISTIVE COMPOSITE MATERIALS AND METHODS FOR MAKING SAME

BACKGROUND OF THE INVENTION

The present invention generally relates to composite materials that are suitable for the protection of personnel and/or property from impact due to ballistic projectiles. Particular embodiments of the composite materials described herein comprise elastomeric materials for the reduction of trauma caused by impact with a ballistic projectile.

Stopping a ballistic projectile prior to entry into the body does not mean that a person will necessarily survive its impact. Even if a person is protected from injury caused by penetration from a ballistic projectile by wearing armor, the person may still be injured or killed due to the trauma inflicted by the ballistic projectile. The term "trauma" as used herein describes injuries caused by an impact on the body even in the absence of ballistic penetration. For example, broken bones, internal bleeding, and/or shock may commonly result from shooting incidents even if the wearer is protected from ballistic penetration by a bullet-proof vest or other protective garment.

The United States National Institute of Justice (NIJ) publishes a series of standards, particularly NIJ Standard-0101.04, to which protective garments, particularly protective or bullet-proof vests, are tested. The test protocols specify the type and velocity of the ballistic threat to be tested, the number and placement of shots, and the criteria for an acceptable test. The foregoing standards take into account trauma damage by measuring the depth of deflection of a backing material such as Roma Plastilina Number One clay created by a nonpenetrating projectile impact, which is referred to as backface signature or BFS. Complete penetration of the body armor or any designated depth measurement of BFS in the backing material of greater than 44 millimeter (mm) by any fair hit shall constitute a failure. The United Kingdom, which has a similar test for measuring BFS known as United Kingdom's Police Scientific Development Branch Stab-resistant Body Armour Test Procedure, considers depth measurements of BFS in the backing material of greater than 25 mm failures. Although no correlation between the BFS results of the NIJ test or UK test and specific injury to human subjects has been officially established, it is known that the overall reduction of trauma increases the likelihood of survival and reduces recovery time and medical costs. Therefore, an important element of survival is the dissipation of the impact shock-wave prior to its reaching the body.

Presently, armor manufacturers address trauma-reduction by typically requiring the utilization of a secondary soft armor pack to be worn behind the primary rigid-type or hard armor. These "trauma packs" as they are frequently termed, contain various layers of ballistic fabrics and foams. Their purpose is two-fold: capture any fragments or spall coming out the backside of the armor and attenuate the shock transmitted to the body of the person being protected. Although trauma packs have shown some success in decreasing the BFS profile of the primary armor by absorbing the energy of impact rather than transmitting it to the wearer, the need to have two layers of armor for protection adds weight and complexity to the final armor package. Trauma packs containing foam padding can typically be uncomfortably thick and trap excess heat and moisture close to the body. Confusion can also arise as to which secondary soft-armor packs have been certified for use with various primary hard-armor components. Thus, it can be seen that the need exists for improved and simplified materials and constructions for absorbing impact energy and reducing trauma to the body.

Elastomers, such as, for example, polyureas, polyurethanes and combinations or derivatives thereof, recently emerged as promising new materials that can accomplish at least one of the following: improve the multi-hit performance of ceramic armor, promote adherence or attachment of ceramic components to metal substrates, and/or protect against spall. Since elastomers can attenuate stress waves rapidly, it is believed that an innovative incorporation of elastomers to primary armor constructs could attenuate trauma and BFS of the primary armor constructs. For example, U.S. Pat. No. 6,532,857 describes the encapsulation of an array of ceramic tiles in an elastomer, typically a polysulfide, to improve the multi-hit performance of lightweight ceramic armor. Similarly, the application WO 2005/103363 A2 describes the encapsulation of either small ceramic inclusions or monolithic plates with a strain-rate hardening polyurea to improve the multi-hit capabilities of ceramic armor. Further, published application US 2007/0017359 A1 describes the using a plural-component spray polyurea as an adhesive to attach a multitude of ceramic spheres to an armor substrate for superior blast and ballistic mitigation.

In addition to trauma-reduction, the overall weight of the final armor package is also important. One of the more common materials used in primary armor is boron carbide ceramic tiles. While ceramic plates have an outstanding ballistic performance to weight ratio, the plates typically require some type of a wrap or coating due in part to its propensity to fracture under rough handling thereby decreasing their ballistic performance. One solution may be to have a coating applied directly to the ceramic plate. This may effectively mitigate trauma by providing protection against fracture while decreasing the overall weight of the armor package, since not as much secondary soft-armor may be needed to pass the NIJ standard trauma requirements.

Accordingly, there is a need in the art for improved materials for absorbing the impact of ballistic projectiles while decreasing the weight of, or eliminating the need for, secondary soft-armor. There is a further need in the art for cost effective methods of making these improved materials.

BRIEF SUMMARY OF THE INVENTION

Described herein is a composite material and method for making same satisfying at least one of the needs in the art by utilizing the energy dissipating properties of certain elastomers synergistically with an impact resistive substrate to reduce the back-face signature (BFS) or trauma of the composite material while simultaneously controlling spall and improving the multi-hit performance of the composite.

BRIEF DESCRIPTION OF SEVERAL VIEWS OF THE DRAWINGS

FIG. 2 provides an embodiment of spray equipment used to make the composite material described herein.

DETAILED DESCRIPTION OF THE INVENTION

Figure 1A:
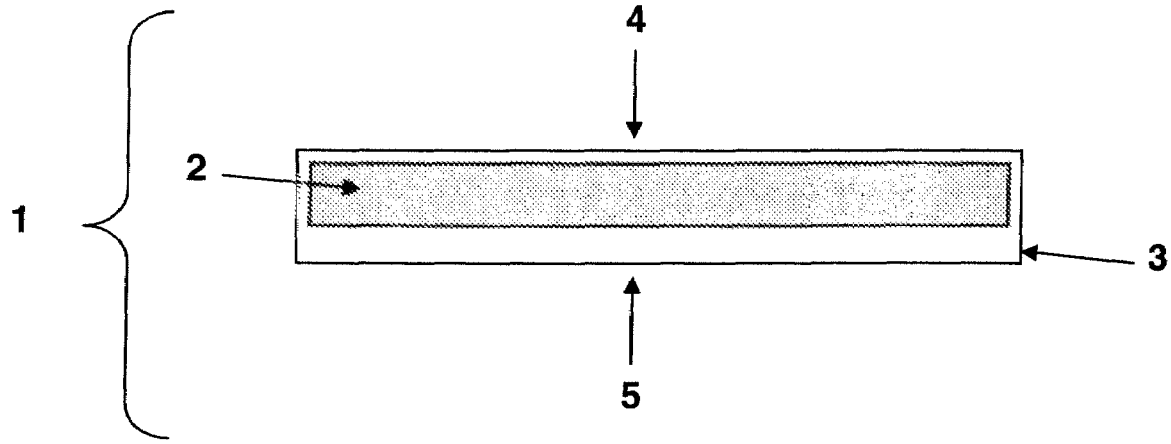
FIG. 1*a* provides a cross-sectional view of one embodiment of the composite material described herein.

Described herein is composite material and method for making same that comprises an impact resistive substrate, such as but not limited to, a ceramic, metal, polymer, fabric, layered composite structure, or combinations thereof, and an elastomer such as but not limited to polyureas, polyurethanes, urea/urethane hybrids or combinations thereof, to improve ballistic performance of the material. By strategically applying the elastomer unequally between the front strike face and the back wear face of the armor—with a relatively heavier layer of the elastomer applied on the back wear face compared to the front strike face—the trauma (or back-face signature) of the armor can be decreased when compared to armor where the elastomer is distributed equally on both front and back sides. It is believed that this arrangement significantly improves the performance of the impact resistive substrate compared to composites where the elastomer is distributed equally on both sides of the impact resistive substrate. In addition to the improvement in back wear face signature reduction, the composite material described herein may also offer at least one of the following advantages: protect against spall, offer multi-hit protection, and, because of the relatively quick-cure nature of the elastomeric coating, offer an ease of manufacture not usually associated with resin systems presently used in the area of armor manufacture.

The composite material described herein provides improved trauma performance for both personnel and property protection. The term "composite material" as used herein describes a material that comprises at least two components (e.g., an impact resistive substrate and an elastomeric material) with significantly different physical or chemical properties and which remain separate and distinct on a macroscopic level within the finished structure. The term composite material also includes but is not limited to laminates, multilayer structures, matrices or variants thereof. The trauma attenuation comes from coating at least a portion of an impact resistive substrate with an energy dissipating elastomer. It is believed that how the impact resistive substrate is coated with the elastomer may minimize the trauma or back-face signature of the final armor construction. In this regard, the elastomer is preferable applied unequally between the front strike face and the back wear face of the armor—with a heavier layer of the elastomer applied on the back—in order to effectively attenuate the trauma without increasing the overall weight of the substrate. The term "strike face" as used herein describes the surface of the armor that faces the ballistic threat. The term "wear face" as used herein describes the surface of the armor that is worn toward the body or property to be protected. The relationship between the coat-weight on the front strike face of the impact resistive substrate and the back wear face of the impact resistive substrate is described herein as: $W_{strike\text{-}face}:W_{wear\text{-}face}$. The $W_{strike\text{-}face}:W_{wear\text{-}face}$ ratio which is also referred to herein as "weight ratio" for the composite material described herein to minimize trauma and weight range should range from 1:1.2 to 1:100, or from 1:1.2 to 1:50, or from 1:1.2 to 1:20.

Figure 1B:
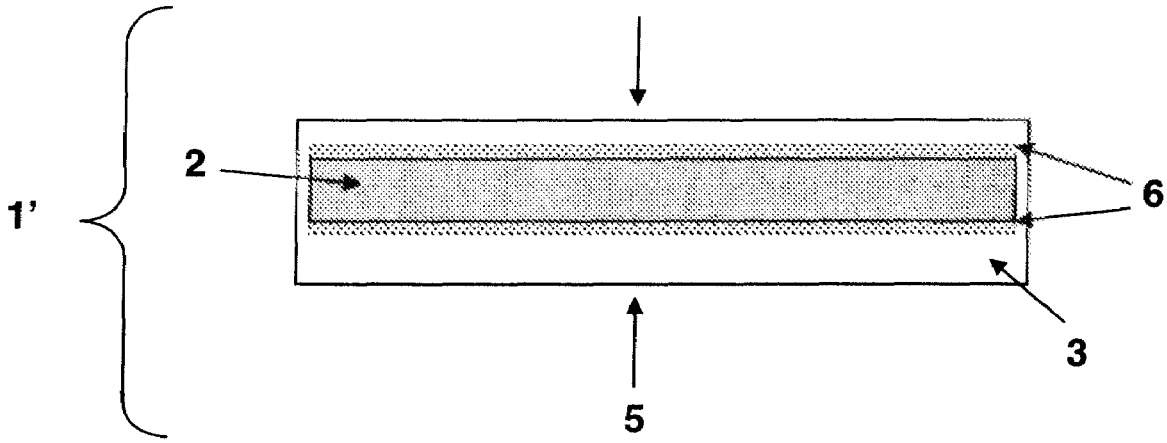
FIG. 1*b* provides a cross-sectional view of another embodiment of the composite material described herein.

FIGS. 1*a* and 1*b* provides a cross-sectional view of two embodiments of the composite material 1 described herein. Referring to FIGS. 1*a* and 1*b*, composite material 1 contains an impact resistive substrate 2 which is coated with an elastomer 3. Reference arrows 4 and 5 refer to the front strike face and back wear face of composite material 1, respectively. FIG. 1*b* further provides adhesion promotion layer 6 which can be applied to one or both surfaces of impact resistive substrate 2 to improve the adherence or elastomer 3 to impact resistive substrate 2. Adhesion promotion layer 6 may comprise an optional adhesive layer, primer layer, adhesion promoter, or combinations thereof. In certain embodiments, adhesion promotion layer 6 may be at least a portion of the surface of impact resistive substrate 2 that has been roughened such as by shot-blasting, acid treatment or other methods to increase the surface area and contact between impact resistive substrate 2 and elastomer 3. While FIGS. 1*a* and 1*b* show composite material 1 as discrete layers, it is understood that in certain embodiments each component of composite material 1 such as for example impact resistive substrate 2, elastomer 3 and adhesion promotion layer 6 may further comprise additional discrete or embedded layers having varying properties.

As previously mentioned, the composite material comprises an impact resistive substrate. The impact resistive substrate contained within the composite material may resist the impact of the projectile or, in certain embodiments, shatter the projectile. The impact resistive substrate can be a ceramic, a metal, an aramid or similar ballistic fabric, a polymer such as polycarbonate or high-density polyethylene, a composite, or combinations thereof. The impact resistive substrate can be, for example, a continuous plate; a woven sheet or fabric; a discontinuous matrix of smaller substrates such as tiles that form the impact resistive substrate; or other arrangements that may provide suitable protection against projectiles once coated by the elastomer. In embodiments where the impact resistive substrate comprises a ceramic, the ceramic monolith can be made from any anti-ballistic ceramic. Additional examples of ceramic materials that are suitable for the impact resistive substrate include, but are not limited to, aluminum oxide (alumina or $Al_2O_3$), boron carbide ($B_4C$), boron nitride (BN), silicon carbide (SiC), silicon nitride ($Si_3N_4$), and zirconium oxide (zirconia or $ZrO_2$). In other embodiments, the impact resistive substrate can be a metal. Examples of suitable metals include, but are not limited to, titanium, aluminum or steel. Any of the chosen impact resistive substrates can be used alone, as a backing or wrapping of another material, as components of a multilayer composition, or any combinations thereof.

The thickness of the impact resistive substrate may be dependent, for example, on the properties of the substrate, the design of the impact resistive substrate within the composite, and/or the relevant threat it is designed to mitigate. In embodiments wherein the threat may be handguns that project armor-piercing bullets or military rifle projectiles, the thickness of the impact resistive substrate may range from 2 millimeter (mm) to 12 mm. However, for composites that are designed to mitigate against significantly larger threats, such as 50 calibers which is generally used to simulate fragments from improvised explosive devices (IEDs), the impact resistive substrate may be thicker or range, for example, from 6 mm to 20 mm.

As mentioned previously, at least a portion of the impact resistive substrate is coated by an elastomer. The elastomer may comprise, but is not limited to, polyurethanes, polyureas, or combinations of elastomeric materials incorporating urethanes, polyureas or hybrids thereof. In certain embodiments, the polymer thermosets and demonstrates medium to high elongation, a medium to high modulus, and high tensile and tear strengths. In one particular embodiment, the elastomer exhibits an elongation ranging from 25-1000% or from 400-900%. In this or other embodiments, the elastomer exhibits a tensile strength ranging from 800 to 10,000 psi or 1,000 to 5,000 psi as measured by ASTM D 412.

In certain embodiments, the elastomer comprises a polyurea. Polyureas are usually defined by the primary functionality in the final reaction. A polyurea is formed from the reaction of a primary or secondary amine with an isocyanate functional group. The amines as well as the isocyanates may be single component or mixed components and may be aliphatic or aromatic in nature. Polyurethane prepolymers of several types may be used in polyurea formulations thereby adding pre-reacted urethane functionality. In addition, a modest amount of hydroxyl functionality (usually less than 10-20% by molar fraction) can be incorporated into the final reaction with the elastomer still being qualified as a polyurea. Generally >20% by molar fraction of a non-amine, isocyanate-reactive functionality shifts the elastomer into being referred to as a hybrid or a polyurea-urethane. Examples of such elastomers are provided in pending U.S. Pub. No. 2006/0223967 which is assigned to the assignee of the present application and incorporated herein by reference in its entirety. The distinctions of polyurea, hybrid and polyurethane are commercial descriptors that attempt to classify a continuum of chemistries from a pure amine-isocyanate reaction to a pure hydroxyl isocyanate reaction.

In certain embodiments, the elastomer comprises a polyurea. By way of example, polyurea elastomers may be derived from the reaction product of an isocyanate (A-side) component and an isocyanate-reactive or resin blend (B-side) component. The isocyanate may be aromatic or aliphatic in nature. Additionally, the isocyanate may be a monomer, a polymer, or any variant reaction of isocyanates, quasi-prepolymer or a prepolymer. The resin blend utilized with the prepolymer or quasi-prepolymer may comprise amine-terminated polymer resins, and/or amine-terminated chain extenders. The resin blend may also contain additives, or non-primary components. For example, the additives may serve cosmetic functions, weight reduction functions, or provide fire-retardant characteristics. These additives may contain hydroxyls, such as pre-dispersed pigments in a polyol carrier.

In addition to polyurea elastomers, a polyurethane/polyurea hybrid elastomer may be utilized which is the reaction product of an isocyanate component and a resin blend component. The isocyanate may be aromatic or aliphatic in nature. Further, the isocyanate may be a monomer, a polymer, or any variant reaction of isocyanates, quasi-prepolymers or prepolymers. The resin blend may comprise blends of amine-terminated polymer resins, hydroxyl-terminated polymer resins, amine-terminated chain extenders, hydroxyl-terminated chain extenders, and combinations thereof. In one embodiment, the resin blend contains blends of amine-terminated and hydroxyl-terminated moieties. The resin blend may also contain, for example, additives, non-primary components, catalysts, and/or other components. In certain embodiments, the amine and/or hydroxyl terminated resins and/or chain extenders can be replaced by other suitable isocyanate-reactive components.

By way of a further example, a polyurethane elastomer may be utilized that is the reaction product of an isocyanate component and a resin blend component. The polyurethane elastomer is the reaction product of hybridized isocyanate/resins. The isocyanate component may be aromatic or aliphatic in nature. Further, the isocyanate component may be a monomer, polymer, or any variant reaction of isocyanates, quasi-prepolymer, or a prepolymer. The resin blend may be made up of hydroxyl-terminated polymer resin, being diol, triol or multi-hydroxyl polyols, and/or aromatic or aliphatic hydroxyl-terminated chain extenders. The resin blend may also contain additives, non-primary components, or catalysts.

The chosen elastomer can be coated onto the impact resistive substrate in a variety of ways such as but not limited to casting, spraying, dipping, roll-on, trowel-on, and/or other application processes. Still further application methods may include compression molding or injection molding processes, such as reaction injection molding (RIM) processes, to provide the composite. Yet another application is to prepare at least one sheet of elastomer which is pre-casted and adhesively bond it to the impact resistive substrate. The later application method is referred to herein as adhesion.

In one particular embodiment, the composite is formed via spraying using plural component spray equipment application. FIG. 2 provides an illustration of such an application method. Plural component spray equipment includes two independent chambers for holding a polyisocyanate prepolymer component 20 and isocyanate-reactive components 21 that when combined forms the elastomeric coating. Flowlines connect the chambers to a proportioner 22 which appropriately meters the two components that when combined form the elastomeric coating to heated flowlines 23 which are heated by a heater 24 to the desired temperature and pressurized. Typically, pressures between about 1,000 pounds per square inch (psi) and about 3,000 psi and temperatures in a range of about 145° F. to about 190° F. are utilized while spraying. In other embodiments, however, the temperature may be as low as room temperature. Once heated and pressurized, the two components are then fed to a mixing chamber 25 located in the spray-gun where they are impingement mixed before being sprayed through the nozzle 26 and onto the armor substrate 27 having a front strike face 28 and a back wear face 29. The two materials are sprayed such that the ratio of coating weight of front strike face 28 and back wear face 29 ranges from 1:1.2 to 1:100 or from 1:1.2 to 1:50 or 1:1.2 to 1:20. Suitable equipment for the method disclosed herein may include, but is not limited to, GUSMER® H-2000, GUSMER® H-3500, and GUSMER® H-20/35 type proportioning units fitted with an impingement-mix spray guy such as the Grace FUSION, GUSMER® GX-7 or the GUSMER® GX-8 (all equipment available from Graco-Gusmer of Lakewood, N.J.). Functionally similar equipment is available from other manufacturers.

Yet another method for forming the composite described herein is as follows. The desired impact resistive substrate is cleaned of surface dirt and oils. If desired, the substrate can be coupled to a selected backing material or wrapped in an aramid or other material prior to coating. The composite may then either be completely coated or encased by the selected elastomer, sandwiched between layers of the elastomer (i.e. coated only on the front strike face and back wear face of impact resistive substrate but not on the sides), and various combinations in between. In embodiments wherein the impact resistive substrate is being fully coated or encapsulated, the sides, front and back wear faces of the substrate are each coated. The ratio of the coat-weight on the front and back of the substrate should fall within the range of from 1:1.2 to 1:100 or from 1:1.2 to 1:50 or from 1:1.2 to 1:20. After coating, the composite can either be heat cured in order to accelerate the physical property development of the coating, or it can be left to ambient cure. The ultimate physical properties of the coating are the same with the slower ambient cure and the forced heat cure.

In certain embodiments, the thickness of the composite may be determined as part of the overall armor package, taking into account the most likely threats as well as the overall weight of the composite. Depending upon the end-use, the dimensions of these substrates usually range from 20×20 cm typical of personal armor configurations up to several meters for vehicular armor. The common dimension for personal protection is approximately 25×30 cm, but smaller or larger dimensions are also used. The impact resistive substrate can be flat, curved or double curved, or any other selected shape of geometry applicable for body armor or protection of other material.

The utility of the present invention will now be illustrated by reference to the following non-limiting working examples wherein procedures and materials are solely representative of those which can be employed, and are not exclusive of those available and operative.

EXAMPLES

The following examples illustrate the ability to prepare composites for use as armor to protect person, property or by applying a relatively heavier layer of coating on the back wear face compared to the front strike face. Although the composites described in the following examples were prepared using a spray-coating technique, other methods of applying the elastomeric coating to the impact resistive substrate can also be used.

Example 1

Preparation of Elastomer Encapsulated Rigid Body-armor with a Front: Back Coat-weight Ratio of 1:1.5

Sample Preparation

A 99% pure $Al_2O_3$ ballistic-grade ceramic SAPI plate—similar to commercially available plates from companies such as Coorstek or Cerradyne—was wiped with an acetone soaked cloth to remove surface dirt and oil. The plate had the dimensions 10"×12"×9 mm, a single-curve radius, a uniform thickness, and weighed 2.60 kg. The polyurea elastomer coating formulation utilized to coat the plate consisted of two components: Part A—Innovathane 101 Isocyanate (Air Products and Chemicals, Inc.) and Part B—Polyshield SS100 Amine (Specialty Products, Inc.).

Both A and B components that form a elastomeric coating were heated to approximately 160° F. in a Gusmer FF18/18 Plural Component Spray Machine, and sprayed onto a ceramic plate at a pressure of approximately 1500 psi with a Graco Fusion air-purge impingement-mix gun. The sides of the plate were coated with 30 grams of elastomer, the front strike face of the plate was coated with 140 grams uniformly applied across the face of the ceramic plate, and the back wear face of the plate was coated with 209 grams uniformly applied across the face of the ceramic plate. This led to a front strike face: back wear face weight ratio of 1:1.5, and a thickness ratio similar to the weight ratio. The plates were cured overnight (~16 hours) at 70° C. The total final coated plate weight was 2.979 kilograms (kg).

In addition to coating the ceramic plates, a free-film of the same elastomer, or Innovathane 101 with Polyshield SS 100 Part B formulation, was sprayed onto a waxed metal sheet for property evaluation. The sheet was cured overnight for 16 hours at 70° C. The coating exhibited the physical properties shown in Table I.

TABLE 1

Elastomer Physical Properties

| Coating Physical Properties (ASTM D-412) | Innovathane 101 with Polyshield SS100 Part B |
|---|---|
| Tensile Strength @ break | 4032 psi |
| Elongation at Break | 321% |
| 100% Modulus | 1351 psi |
| Die-C Tear Strength (ASTM D-624) | 610 lb/in |

Ballistics Testing

Ballistics testing was performed in accordance with a modified version of the NIJ-STD-0101.04, BALLISTIC RESISTANCE OF PERSONAL BODY ARMOR, Level 3 using caliber 7.62×51 mm 149 grain, M80 Ball ammunition was conducted at the independent testing laboratory H.P. White Laboratories in Street, Md. The testing was modified to use a lower bullet velocity, no environmental conditioning of the samples, and the performance of each test sample was evaluated after each shot and averaged. The test samples were positioned on an indoor range 50.0 feet from the muzzle of a test barrel. Chronographs were utilized to compute projectile velocities. Table II summarizes the results from the testing.

TABLE II

Ballistics Testing on 9 mm ceramic plate with encapsulant coat-weight ratio of 1:1.5 (front strike face:back wear face)

| Shot Number | Average Velocity | Penetration | Back wear face Signature | Soft Armor Pack |
|---|---|---|---|---|
| 1 | 2509 ft/s | No | 21 mm | Armourshield IIIA Pack (Serial# 1615070003) |
| 2 | 2480 ft/s | No | 25 mm | Armourshield IIIA Pack (Serial# 1615070003) |
| 3 | 2507 ft/s | No | 25 mm | Armourshield IIIA Pack (Serial# 1615070003) |
| Average | 2499 ft/s | None | 23.7 mm | |

Example 2

Preparation of Elastomer Encapsulated Rigid Body-armor with a Front: Back Coat-weight Ratio of 1:2

Sample Preparation

A 99% pure $Al_2O_3$ ballistic-grade ceramic SAPI plate—similar to commercially available plates from companies such as Coorstek or Cerradyne—was wiped with an acetone soaked cloth to remove surface dirt and oil. The plate had the dimensions 10"×12"×9 mm, a single-curve radius, a uniform thickness, and weighed 2.605 kg. The polyurea elastomer coating formulation utilized to coat the plate consisted of two components: Part A—Innovathane 101 Isocyanate (Air Products and Chemicals, Inc.) and Part B—Polyshield SS100 Amine (Specialty Products, Inc.).

Both A and B components that form the elastomeric coating were heated to approximately 160° F. in a Gusmer FF18/18 Plural Component Spray Machine, and sprayed onto the ceramic plate at a pressure of approximately 1500 psi with a Graco Fusion air-purge impingement-mix gun. The sides of the plate were coated with 35 grams of elastomer, the front strike face of the plate was coated with 119 grams uniformly applied across the face of the ceramic plate, and the back wear face of the plate was coated with 232 grams uniformly applied across the face of the ceramic plate. This led to a front strike face: back wear face weight ratio of 1:2 and a thickness ratio similar to the weight ratio. The plates were cured overnight (~16 hours) at 70° C. and had the same physical properties as those shown in Table I. The total final coated plate weight was: 2.99 kg.

Ballistics Testing

Ballistics testing was performed as described in Example 1. Table III summarizes the ballistics test results.

TABLE III

Ballistics Testing on 9 mm ceramic plate with encapsulant coat-weight ratio of 1:2 (front strike face:back wear face)

| Shot Number | Average Velocity | Penetration | Back wear face Signature | Soft Armor Pack |
|---|---|---|---|---|
| 1 | 2484 ft/s | No | 24 mm | Armourshield IIIA Pack (Serial# 1615070003) |
| 2 | 2481 ft/s | No | 24 mm | Armourshield IIIA Pack (Serial# 1615070003) |
| 3 | 2495 ft/s | No | 29 mm | Armourshield IIIA Pack (Serial# 1615070003) |
| 4 | 2424 ft/s | No | 29 mm | Armourshield IIIA Pack (Serial# 1615070003) |
| 5 | 2488 ft/s | No | 23 mm | Armourshield IIIA Pack (Serial# 1615070003) |
| Average | 2474 ft/s | None | 25.6 mm | |

Example 3

Preparation of Elastomer Encapsulated Rigid Body-armor with a Front: Back Coat-weight Ratio of 1:2

Sample Preparation

A 95% pure $Al_2O_3$ ballistic-grade ceramic SAPI plate—similar to commercially available plates from companies such as Coorstek or Cerradyne—was wiped with an acetone soaked cloth to remove surface dirt and oil. The plate had the dimensions 10"×12"×9 mm, a multi-curved radius, chamfered edges, and weighed 2.031 kg. The polyurea elastomer coating formulation utilized to coat the plate consisted of two components: Part A—Innovathane 101 Isocyanate (Air Products and Chemicals, Inc.) and Part B—Polyshield SS100 Amine (Specialty Products, Inc.).

Both A and B components were heated to approximately 160° F. in a Gusmer FF18/18 Plural Component Spray Machine, and sprayed onto the ceramic plate at a pressure of approximately 1500 psi with a Graco Fusion air-purge impingement-mix gun. The sides of the plate were coated with 15 grams of elastomer, the front strike-face of the plate was coated with 74 grams uniformly applied across the face of the ceramic plate, and the back-face of the plate was coated with 280 grams uniformly applied across the face of the ceramic plate. This led to a front strike face: back wear face weight ratio of 1:3.8 and a thickness ratio similar to the weight ratio. The plates were cured overnight (~16 hours) at 70° C. and had the same physical properties as those shown in Table I. The total final coated plate weight was: 2.40 kg.

Ballistics Testing

Ballistics testing was performed as described in Example 1. Table IV summarizes the ballistics test results.

TABLE IV

Ballistics Testing on 8.2 mm ceramic plate with encapsulant coat-weight ratio of 1:3.8 (front strike face:back wear face)

| Shot Number | Average Velocity | Penetration | Back wear face Signature | Soft Armor Pack |
|---|---|---|---|---|
| 1 | 2499 ft/s | No | 22 mm | Armourshield IIIA Pack (Serial# 1615070003) |
| 2 | 2440 ft/s | No | 27 mm | Armourshield IIIA Pack (Serial# 1615070003) |
| 3 | 2450 ft/s | No | 29 mm | Armourshield IIIA Pack (Serial# 1615070003) |
| 4 | 2444 ft/s | No | 31 mm | Armourshield IIIA Pack (Serial# 1615070003) |
| 5 | 2511 ft/s | No | 34 mm | Armourshield IIIA Pack (Serial# 1615070003) |
| 6 | 2496 ft/s | No | 27 mm | Armourshield IIIA Pack (Serial# 1615070003) |
| Average | 2472 ft/s | None | 28 mm | |

Comparative Examples A, B, and C

Comparative Examples A, B and C were prepared according to the same methodology described in Examples 1, 2 and 3, however instead of utilizing a unequal front: back coat-weight ratio, an equal distribution of coating was applied to the front and back strike faces (i.e. ratio of 1:1). Identical polymer weights and ceramic plates were utilized on Examples 1 and Comparative Example A to show the impact of the unequal coat-weight distribution on the back-face signature of the armor. Similarly, the ceramic plate and polymer weight on Examples 2 and Comparative Example B are identical. Example 3, however, utilizes a ceramic plate that is 200 grams lighter than the plate utilized in Comparative Example C. This difference enables us, with the same applied polymer weight, to show how a heavier backing of the polymer on the ceramic plate enables us to maintain a back-face signature of 28 mm while decreasing the overall armor weight by 200 grams.

At the end of the Comparative Examples, Table VIII pairs the Examples and their corresponding Comparative Examples so that the results can be summarized succinctly.

Comparative Example A

Preparation of Elastomer Encapsulated Rigid Body-armor with a Front: Back Coat-weight Ratio of 1:1

Sample Preparation

A 99% pure $Al_2O_3$ ballistic-grade ceramic SAPI plate—similar to commercially available plates from companies such as Coorstek or Cerradyne—was wiped with an acetone soaked cloth to remove surface dirt and oil. The plate had the dimensions 10"×12"×9 mm, a single-curve radius, a uniform thickness, and weighed 2.613 kg. The polyurea elastomer coating formulation utilized to coat the plate consisted of two components: Part A—Innovathane 101 isocyanate (Air Products and Chemicals, Inc.) and Part B—Polyshield SS100 Amine (Specialty Products, Inc.).

Both A and B components were heated to approximately 160° F. in a Gusmer FF18/18 Plural Component Spray Machine, and sprayed onto the ceramic plate at a pressure of approximately 1500 psi with a Graco Fusion air-purge impingement-mix gun. The sides of the plate were coated with 30 grams of elastomer, the front strike-face of the plate was coated with 170 grams uniformly applied across the face of the ceramic plate, and the back-face of the plate was coated with 165 grams uniformly applied across the face of the ceramic plate. This led to a front strike face: back wear face weight ratio of 1:1 and a thickness ratio similar to the weight ratio. The plates were cured overnight (~16 hours) at 70° C. and had the same physical properties as those shown in Table I. The total final coated plate weight was: 2.978 kg.

Ballistics Testing

Ballistics testing was performed as described in Example 1. Table V summarizes the ballistics test results. Compared to the test data in Example 1, it is clear that at the same polymer and ceramic weight, the 1:1.4 coat-weight ratio plate outperforms the 1:1 coat-weight plate in Back wear face Signature performance by nearly 10% (23.7 mm vs. 26.5 mm).

TABLE V

Ballistics Testing on 9 mm ceramic plate with encapsulant coat-weight ratio of 1:1 (front strike face:back wear face)

| Shot Number | Average Velocity | Penetration | Back wear face Signature | Soft Armor Pack |
|---|---|---|---|---|
| 1 | 2463 ft/s | No | 30 mm | Armourshield IIIA Pack (Serial# 1615070003) |
| 2 | 2413 ft/s | No | 25 mm | Armourshield IIIA Pack (Serial# 1615070003) |
| 3 | 2496 ft/s | No | 29 mm | Armourshield IIIA Pack (Serial# 1615070003) |
| 4 | 2440 ft/s | No | 22 mm | Armourshield IIIA Pack (Serial# 1615070003) |
| Average | 2453 ft/s | None | 26.5 mm | |

Comparative Example B

Preparation of Elastomer Encapsulated Rigid Body-Armor with a Front: Back Coat-Weight Ratio of 1:1

Sample Preparation

A 99% pure $Al_2O_3$ ballistic-grade ceramic SAPI plate—similar to commercially available plates from companies such as Coorstek or Cerradyne—was wiped with an acetone soaked cloth to remove surface dirt and oil. The plate had the dimensions 10"×12"×9 mm, a single-curve radius, a uniform thickness, and weighed 2.60 kg. The polyurea elastomer coating formulation utilized to coat the plate consisted of two components: Part A—Innovathane 101 Isocyanate (Air Products and Chemicals, Inc.) and Part B—Polyshield SS100 Amine (Specialty Products, Inc.).

Both A and B components were heated to approximately 160° F. in a Gusmer FF18/18 Plural Component Spray Machine, and sprayed onto the ceramic plate at a pressure of approximately 1500 psi with a Graco Fusion air-purge impingement-mix gun. The sides of the plate were coated with 38 grams of elastomer, the front strike-face of the plate was coated with 162 grams uniformly applied across the face of the ceramic plate, and the back-face of the plate was coated with 170 grams uniformly applied across the face of the ceramic plate. This led to a front strike face: back wear face weight ratio of 1:1 and a thickness ratio similar to the weight ratio. The plates were cured overnight (~16 hours) at 70° C. and had the same physical properties as those shown in Table I. The total final coated plate weight was: 2.97 kg.

Ballistics Testing

Ballistics testing was performed as described in Example 1. Table VI summarizes the ballistics test results. Compared to the test data in Example 2, it is clear that at the same polymer and ceramic weight, the 1:2 coat-weight ratio plate outperforms the 1:1 coat-weight plate in Back wear face Signature performance by nearly 20% (25.6 mm vs. 31.2 mm).

TABLE VI

Ballistics Testing on 9 mm ceramic plate with encapsulant coat-weight ratio of 1:1 (front strike face:back wear face)

| Shot Number | Average Velocity | Penetration | Back wear face Signature | Soft Armor Pack |
|---|---|---|---|---|
| 1 | 2432 ft/s | No | 22 mm | Armourshield IIIA Pack (Serial# 1615070003) |
| 2 | 2454 ft/s | No | 33 mm | Armourshield IIIA Pack (Serial# 1615070003) |
| 3 | 2403 ft/s | No | 24 mm | Armourshield IIIA Pack (Serial# 1615070003) |
| 4 | 2456 ft/s | No | 35 mm | Armourshield IIIA Pack (Serial# 1615070003) |
| 5 | 2492 ft/s | No | 38 mm | Armourshield IIIA Pack (Serial# 1615070003) |
| 6 | 2472 ft/s | No | 35 mm | Armourshield IIIA Pack (Serial# 1615070003) |
| Average | 2451 ft/s | None | 31.2 mm | |

Comparative Example C

Preparation of Elastomer Encapsulated Rigid Body-armor with a Front: Back Coat-weight ratio of 1:1

Sample Preparation

A 95% pure $Al_2O_3$ ballistic-grade ceramic SAPI plate—similar to commercially available plates from companies such as Coorstek or Cerradyne—was wiped with an acetone soaked cloth to remove surface dirt and oil. The plate had the dimensions 10"×12"×9 mm, a single-curve radius, chamfered edges, and weighed 2.218 kg. The polyurea elastomer coating formulation utilized to coat the plate consisted of two components: Part A—Innovathane 101 Isocyanate (Air Products and Chemicals, Inc.) and Part B—Polyshield SS100 Amine (Specialty Products, Inc.).

Both A and B components were heated to approximately 160° F. in a Gusmer FF18/18 Plural Component Spray Machine, and sprayed onto the ceramic plate at a pressure of approximately 1500 psi with a Graco Fusion air-purge impingement-mix gun. The sides of the plate were coated with 15 grams of elastomer, the front strike-face of the plate was coated with 184 grams uniformly applied across the face of the ceramic plate, and the back-face of the plate was coated with 177 grams uniformly applied across the face of the ceramic plate. This led to a front strike face: back wear face weight ratio of 1:1 and a thickness ratio similar to the weight ratio. The plates were cured overnight (~16 hours) at 70° C. and had the same physical properties as those shown in Table I. The total final coated plate weight was: 2.60 kg.

Ballistics Testing

Ballistics testing was performed as described in Example 1. Table VII summarizes the ballistics test results. Compared to the test data in Example 3, we show here that by utilizing the same quantity of polymer on two plates, we can maintain the same back-face signature on a thinner, lighter-weight ceramic plate simply by placing more polymer on the back-side of the plate in a 1:4 weight ratio. This allows us to maintain the same back-face signature while lowering the overall armor weight by 200 grams (27.3 mm for a 2.6 kg construction vs. 28 mm for a 2.4 kg construction).

TABLE VII

Ballistics Testing on 8.3 mm ceramic plate with encapsulant coat-weight ratio of 1:1 (front strike face:back wear face)

| Shot Number | Average Velocity | Penetration | Back wear face Signature | Soft Armor Pack |
|---|---|---|---|---|
| 1 | 2379 ft/s | No | 21 mm | Armourshield IIIA Pack (Serial# 1615070003) |
| 2 | 2444 ft/s | No | 29 mm | Armourshield IIIA Pack (Serial# 1615070003) |
| 3 | 2404 ft/s | No | 25 mm | Armourshield IIIA Pack (Serial# 1615070003) |
| 4 | 2420 ft/s | No | 28 mm | Armourshield IIIA Pack (Serial# 1615070003) |
| 5 | 2460 ft/s | No | 33 mm | Armourshield IIIA Pack (Serial# 1615070003) |
| Average | 2421 ft/s | None | 27.3 mm | |

As these Examples and Comparative Examples have demonstrated, the utilization of a distribution ratio of coat-weights of elastomer on the front- and back-faces of the ballistic substrate can significantly improve the back-face signature of the armor compared to a similar weight of elastomer applied equally to the front and back (or alternatively, can allow significant weight reduction while maintaining the BFS). A summary of the data for corresponding Examples and Comparative Example has been provided in Table VIII.

TABLE VIII

Summary of Data Comparing Examples 1, 2 and 3 with Corresponding Comparative Examples A, B and C

| Plate ID | Ceramic Weight | Polyurea Weight | Total Armor Weight | Front:Back Weight Ratio | Average Velocity | Average Back wear face Signature |
|---|---|---|---|---|---|---|
| Example 1 | 2.60 kg | 379 g | 2.98 kg | 1:1.5 | 2499 ft/s | 23.7 mm |
| Comparative Example A | 2.613 kg | 365 g | 2.98 kg | 1:1 | 2453 ft/s | 26.5 mm |
| Example 2 | 2.605 kg | 385 g | 2.99 kg | 1:2 | 2474 ft/s | 25.6 mm |
| Comparative Example B | 2.613 kg | 365 g | 2.98 kg | 1:1 | 2451 ft/s | 31.2 mm |
| Example 3 | 2.031 kg | 369 g | 2.40 kg | 1:3.8 | 2472 ft/s | 28 mm |
| Comparative Example C | 2.218 kg | 376 g | 2.60 kg | 1:1 | 2421 ft/s | 27.3 mm |

The invention claimed is:

1. A composite for resisting impact from an oncoming projectile having a front strike face and a back wear face comprising:

an elastomer; and an impact resistive substrate wherein at least a portion of the impact resistive substrate is coated by the elastomer to provide the composite having a front strike face coating and a back wear face coating and wherein a weight ratio of front strike face coating to back wear face coating ranges from 1:1.2 to 1:100.

2. The composite of claim 1 further comprising an adhesion promotion layer disposed between at least one surface of the elastomer and at least one surface of the impact resistive substrate.

3. The composite of claim 1 wherein the elastomer comprises at least one selected from the group consisting of a polyurethane, a polyurea, and combinations thereof.

4. The composite of claim 3 wherein the elastomer comprises polyurea.

5. The composite of claim 4 wherein the impact resistive substrate comprises at least one selected from the group consisting of a ceramic, a metal, an aramid ballistic fabric, a polymer, and combinations thereof.

6. The composite of claim 5 wherein the impact resistive substrate comprises the ceramic.

7. The composite of claim 6 wherein the ceramic is at least one selected from the group consisting of aluminum oxide, boron carbide, boron nitride, silicon carbide, silicon nitride, zirconium oxide, and combinations thereof.

8. The composite of claim 7 wherein the ceramic comprises aluminum oxide.

9. The composite of claim 1 wherein the weight ratio ranges from 1:1.2 to 1:20.

10. A composite for resisting impact from an oncoming projectile having a front strike face and a back wear face comprising:

an elastomer selected from the group consisting of at least one selected from the group consisting of a polyurethane, a polyurea, and combinations thereof;

an impact resistive substrate selected from the group consisting of a ceramic, a metal, an aramid ballistic fabric, a polymer, and combinations thereof, wherein at least a portion of the impact resistive substrate is coated by the elastomer to provide the composite having a front strike face coating and a back wear face coating and wherein a weight ratio of front strike face coating to back wear face coating ranges from 1:1.2 to 1:100; and optionally an adhesion promotion layer disposed between at least one surface of the elastomer and at least one surface of the impact resistive substrate.

11. The composite of claim 10 wherein the weight ratio ranges from 1:1.2 to 1:20.

12. A composite for resisting impact from an oncoming projectile having a front strike face and a back wear face comprising:

an elastomer comprising a polyurea; and an impact resistive substrate comprising a ceramic wherein at least a portion of the impact resistive substrate is coated by the elastomer to provide the composite having a front strike face coating and a back wear face coating and wherein a weight ratio of front strike face coating to back wear face coating ranges from 1:1.2 to 1:100 and wherein the ceramic comprises aluminum oxide.

13. A composite for resisting impact from an oncoming projectile having a front strike face and a back wear face comprising:

an elastomer comprising a polyurea;

an impact resistive substrate comprising a ceramic wherein the ceramic comprises aluminum oxide, wherein at least a portion of the impact resistive substrate is coated by the elastomer to provide the composite having a front strike face coating and a back wear face coating and wherein a weight ratio of front strike face coating to back wear face coating ranges from 1:1.2 to 1:100; and optionally an adhesion promotion layer disposed between at least one surface of the elastomer and at least one surface of the impact resistive substrate.

* * * * *